US007726043B2

(12) United States Patent
Shuttleworth et al.

(10) Patent No.: US 7,726,043 B2
(45) Date of Patent: Jun. 1, 2010

(54) STUDDED FOOTWEAR

(75) Inventors: Lee Paul Shuttleworth, Birmingham (GB); Paul Andrew Kelly, Warwickshire (GB)

(73) Assignee: Trisport Limited, Amington, Tamworth, Staffordshire (GB)

( * ) Notice: Subject to any disclaimer, the term of this patent is extended or adjusted under 35 U.S.C. 154(b) by 1048 days.

(21) Appl. No.: 10/541,426

(22) PCT Filed: Jan. 9, 2004

(86) PCT No.: PCT/GB2004/000092

§ 371 (c)(1),
(2), (4) Date: Mar. 21, 2006

(87) PCT Pub. No.: WO2004/062413

PCT Pub. Date: Jul. 29, 2004

(65) Prior Publication Data

US 2006/0162189 A1 Jul. 27, 2006

(30) Foreign Application Priority Data

Jan. 11, 2003 (GB) ..... 0300657.4

(51) Int. Cl.
*A43B 5/00* (2006.01)

(52) U.S. Cl. ..... 36/67 D; 36/134

(58) Field of Classification Search ..... 36/67 R, 36/67 D, 134, 126–129
See application file for complete search history.

(56) References Cited

U.S. PATENT DOCUMENTS 1,809,194 A * 6/1931 East ..... 36/59 R
2,192,150 A * 2/1940 Pierce et al. ..... 36/134
2,299,927 A * 10/1942 Pierce et al. ..... 36/59 R
2,324,591 A * 7/1943 Olson ..... 36/59 R
2,918,733 A 12/1959 Anderson
3,040,449 A * 6/1962 Phillips ..... 36/127
3,204,347 A * 9/1965 Snow ..... 36/107
3,302,227 A * 2/1967 Bente ..... 12/142 P
3,882,614 A * 5/1975 Albaladejo ..... 36/67 D
4,306,360 A * 12/1981 Hagger ..... 36/59 R
4,706,394 A 11/1987 Regula
5,205,056 A * 4/1993 Okajima et al. ..... 36/131
5,848,482 A * 12/1998 Bathum ..... 36/127

(Continued)

FOREIGN PATENT DOCUMENTS

DE 3924360 1/1991

*Primary Examiner*—Marie Patterson
(74) *Attorney, Agent, or Firm*—Edell, Shapiro & Finnan, LLC

(57) ABSTRACT

Some studded footwear, such as sports shoes, require studs to be specifically oriented relative to the shoe sole. The studs may be specifically oriented in the receptacles, and thus the receptacles need to be oriented relative to the sole of the shoe. Means are provided therefore for orienting a specifically-oriented receptacle for a shoe stud in a multi-layer shoe sole comprising co-operating orienting means on the receptacle and an outer shoe sole, the co-operating orienting means being operative to physically retain the receptacle in the correct orientation relative to the outer shoe sole at least until an inner shoe sole is secured to the outer shoe sole. Thus the co-operating orienting means serve to ensure that a specifically-oriented receptacle is physically held in the correct orientation relative to the shoe sole, at least until the shoe sole is completed by attachment of an inner shoe sole.

8 Claims, 2 Drawing Sheets

U.S. PATENT DOCUMENTS 5,901,472 A * 5/1999 Adam ..... 36/134
6,154,984 A * 12/2000 Adam ..... 36/134
6,301,806 B1 * 10/2001 Heller ..... 36/134
6,421,937 B2 * 7/2002 Heller ..... 36/134
2005/0160629 A1 * 7/2005 Jungkind ..... 36/127

* cited by examiner

STUDDED FOOTWEAR

This invention relates to studded footwear such as sports shoes, for example football boots and golf shoes. The term 'football' is intended to encompass all sports known as football, such as soccer, rugby and American and Australian football.

The studs are intended to provide traction, having a ground-engaging part of a type suited to the sport involved. Thus, studs for football tend to have relatively sharp ground-piercing spikes, while those for golf shoes currently have several relatively soft and blunt ground-gripping spikes. The studs are detachably fastened to the sole of the article of footwear, by a screw-threaded spigot on the stud engaging in a correspondingly threaded socket in a receptacle moulded in, or otherwise secured to, the shoe sole.

The screw-threaded connection must be designed to ensure that the stud remains in place, even when high forces are applied, and in particular that it does not unscrew accidentally. Known studs have either a single start thread or a multi-start thread. A single start thread is the simplest thread form, and provides a greater resistance to unscrewing than a multi-start thread. It also provides a strong connection over the several turns of the thread on the spigot and socket. However, because of the number of turns needed to attach and detach the stud, removal and replacement becomes a time-consuming operation. A multi-start thread has a steeper helix angle, which enables a spigot of any given length to be inserted into the socket with less rotation. Also, because a multi-start thread is deeper cut than a single start thread, the shear strength of the thread is greater, so that a shorter spigot can be used.

Whether a single start or multi-start thread is used, the studs and sockets also incorporate a locking ratchet to prevent accidental unscrewing of the studs. Typically, the stud and socket each have a set of teeth, which interengage as the stud is inserted into the socket. The arrangement of the teeth allows the stud to be in any one of a number of positions relative to the socket when it is fully inserted.

The screw threads and locking ratchets described are quite adequate where the rotational orientation of the stud relative to the sole is not significant. In fact, currently most studs are circular or otherwise rotationally symmetrical, and their final orientation relative to the shoe sole is not relevant.

However, in some sports where the forces on the studs are relatively high and of a particular type, such as lateral forces or forces due to rapid forward acceleration of the wearer of the shoe, studs which are specifically oriented can be more effective. (The term "specifically-oriented stud" will be used to include studs which are non-rotationally symmetrical, or studs which are rotationally symmetrical, but whose orientation relative to the shoe sole is significant.) A specifically-oriented stud must be oriented very precisely relative to the shoe sole to ensure that it operates in the desired manner. The known screw-threads and locking ratchets are unable to provide this precise orientation. For example, although a single start thread orients the stud at the start of its insertion, the multiple turns and the locking ratchet mean that its final position cannot be predicted. A multi-start thread of course provides a plurality of starting positions, and the locking ratchet a plurality of end positions.

Our previous design work has been to ensure that a stud can be oriented precisely relatively to its socket and receptacle. This invention aims to provide precise orientation of a specifically-oriented receptacle relative to the shoe sole. The term 'specifically-oriented receptacle' will be used to mean receptacles for specifically-oriented studs.

According to the present invention, means for orienting a specifically-oriented receptacle for a shoe stud in a multi-layer shoe sole comprises co-operating orienting means on the receptacle and an outer shoe sole, the co-operating orienting means being operative to physically retain the receptacle in the correct orientation relative to the outer shoe sole at least until an inner shoe sole is secured to the outer shoe sole.

Thus the co-operating orienting means serve to ensure that a specifically-oriented receptacle is physically held in the correct orientation relative to the shoe sole, at least until the shoe sole is completed by attachment of an inner shoe sole.

The orienting means preferably comprises an additional part secured to the receptacle, co-operating with a formation on the outer shoe sole.

The additional part may comprise a flange projecting from at least part of the periphery of the receptacle. The flange may be of a non-rotationally symmetrical shape. The co-operating formation on the outer shoe sole may then comprise a corresponding recess. The recess may be defined by a continuous projecting wall, or by spaced projections.

Alternatively, the flange may be of rotationally symmetrical shape, but have an aperture or apertures arranged to provide non-rotational symmetry. The outer shoe sole is then provided with projections corresponding to and received by the apertures to provide the necessary orientation. A flange of non-rotationally symmetrical shape may also be provided with one or more apertures, and the outer shoe sole with corresponding projections. In either case, the apertures and projections help to retain the receptacles in the finished shoe sole.

The flange may be formed integrally with the receptacle, for example by injection moulding. Alternatively, the flange may be moulded over the receptacle, in a separate operation.

Various embodiments of the invention is illustrated by way of example in the accompanying drawings, in which FIG. 1 is a section through a shoe sole including a receptacle and a shoe stud;

Figure 1:
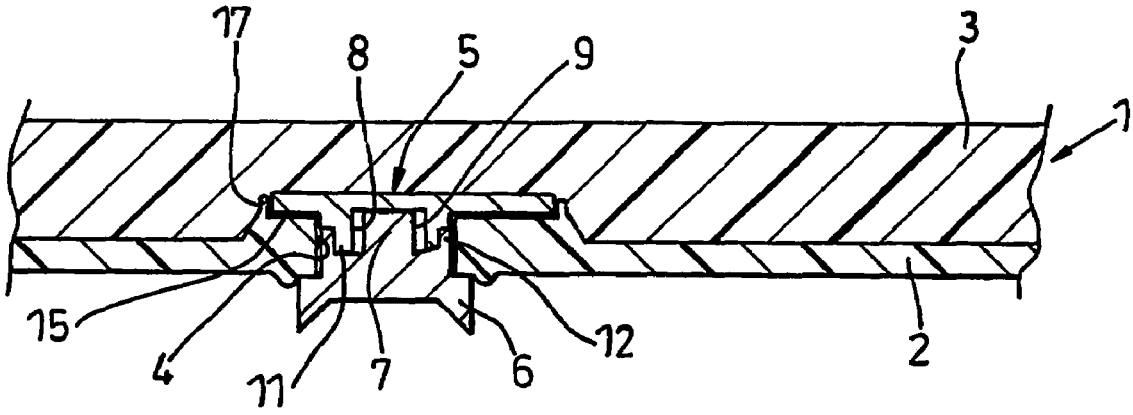

FIG. 1 shows a multi-layer shoe sole 1 for a studded sports shoe such as a golf shoe (not shown further). The shoe sole 1 has an outer sole 2, to which is secured an inner sole 3. The outer sole 2 has apertures 4 (only one of which is shown). Each aperture 4 accommodates a receptacle 5 in which a shoe stud 6 is detachably fastened. The receptacles 5 are located in the outer shoe sole 2 before the inner sole 3 is secured to it, for example by moulding. Securing the inner sole 3 also acts to retain the receptacles 5 in position. The receptacles 5 are precisely oriented relative to the outer sole 2, as described in more detail below.

Each stud 6 is fastened to a receptacle 5 by a screw-threaded spigot 7 on the stud engaging in a correspondingly threaded socket 8 in the receptacle 5. The spigot 7 and socket 8 have a three-start thread, which enables the stud 6 to be attached with half a turn of the stud. One of the male threads 9 on the stud 6 is radially enlarged in comparison with the other two, and the socket 8 has a correspondingly shaped female thread 10. This ensures that the spigot 7 can start engaging with the socket 8 in only one position of the possible three in order to determine the starting position of the stud 6 relative to the receptacle 5. The receptacle 5 and stud 6 also have a locking means, in the form of a ring of teeth 11 formed on the radially outer surface of the socket 8 and a ring of resilient posts 12 formed concentric with and spaced from the spigot 7. As the spigot 7 is screwed into the socket 8 the teeth 11 engage with the posts 12, which deflect resiliently in a radially outwards direction to allow the teeth 11 to pass. Engagement of the teeth 11 between the posts 12 when the spigot 7 is fully inserted in the socket 8 locks the spigot 7 to the receptacle 5. This ensures that the final position of the stud 6 relative to the receptacle 5 is also precisely determined.

This precise orientation of the stud 6 relative to the receptacle 5 is essential if the stud 6 is a specifically-oriented stud. In accordance with the invention the receptacle 5 is a specifically-oriented receptacle, whose position relative to the outer sole 2 is also precisely determined.

Figure 2:
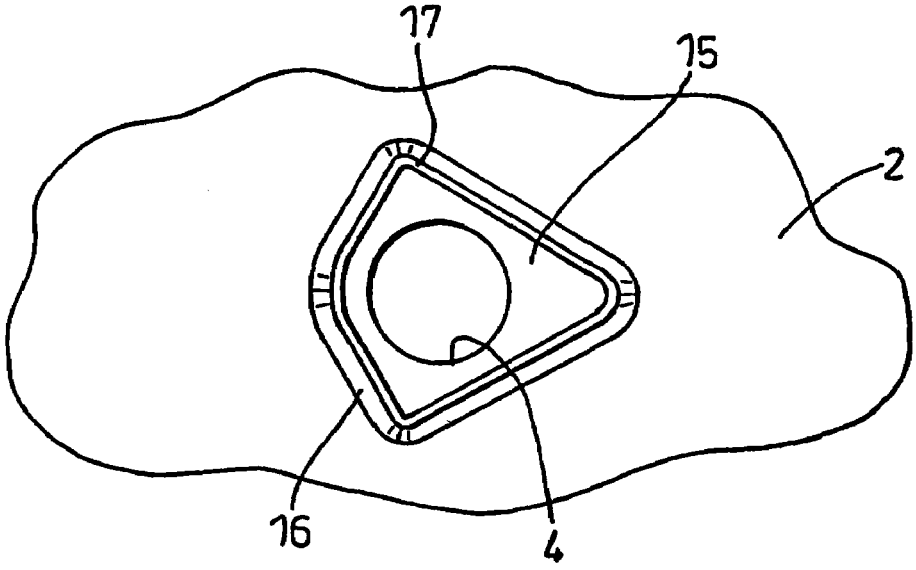
FIG. 2 is a plan view of part of an outer shoe sole of FIG. 1.
Figure 3:
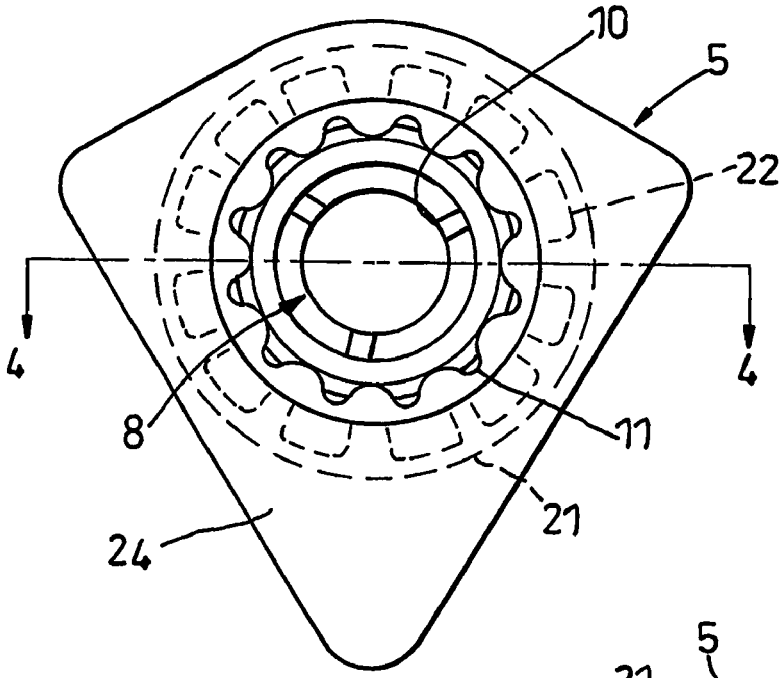
FIG. 3 is a plan view of the receptacle of FIG. 1.

As shown in particular in FIGS. 2 and 3, the receptacle 5 and outer sole 2 have co-operating orienting means 13 to ensure the precise orientation of the receptacle 5 relative to the outer sole 2. Thus, the receptacle 5 has a non-rotationally symmetrical peripheral outline 14, while the outer sole 2 has a corresponding shaped recess 15. The outer sole 2 is moulded from a rubber or similar material.

The part of the outer sole 2 shown in FIG. 2 has an aperture 4, round which is formed a relatively thick reinforcing portion 16. The upper surface of the portion 16 is substantially flat, but is formed with a continuous peripheral lip 17 to define a recess 15 of substantially kite shape, with rounded corners. The aperture 4 is placed towards the top end of the kite shape.

Figure 4:
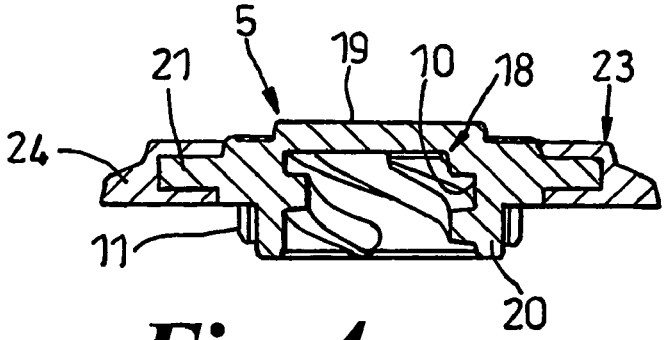
FIG. 4 is a section on the line 4-4 of FIG. 3.

The receptacle 5 of FIGS. 3 and 4 is designed to fit in the recess 15. The receptacle 5 is made in two parts. A first part 18 is a unitary moulding of plastics material, having a circular top plate 19 with a central boss 20 depending from it. An annular flange 21 is formed by a portion of the top plate 19 projecting radially outward beyond the boss 20. The flange 21 has apertures 22. The boss 20 has a cylindrical wall, on the radially inner surface of which is formed the screw-threaded socket 8. The radially outer surface of the boss 20 is formed with the teeth 11.

A second part 23 of the receptacle 5 is also of plastics material, and is overmoulded on the first part 18. The second part 23 consists of a plate 24 moulded round the flange 21 and apertures 22. The plate 24 is substantially kite-shaped with rounded corners, corresponding to the recess 15. It will be appreciated therefore that when the receptacle 5 is located on the outer sole 2 the boss 20 is received in the aperture 4, and the plate 24 is received in the recess 15. As the plate 24 and recess 15 have non-rotationally symmetrical outlines, the receptacle 5 can be located in only one position in the outer sole 2.

The outer sole 2 and the receptacles 5 are manufactured separately. To complete the sole 1, the upper surface of the outer sole 2 is coated with adhesive, and the receptacles 5 located in the recesses 15. The adhesive acts to retain the receptacles 5 while the inner sole 3 is secured by moulding or in any suitable way.

Figure 5:
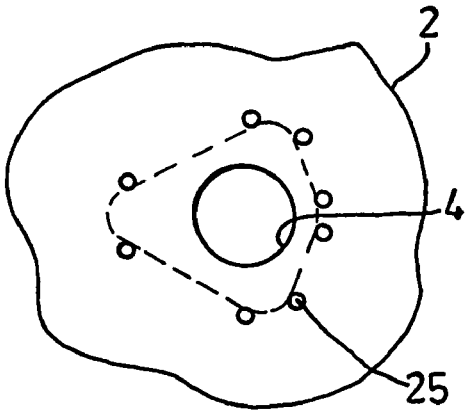
FIG. 5 is similar to FIG. 2, but shows a modification.

FIG. 5 shows a modification in which the orienting means on the outer sole 2 comprises several spaced upstanding pegs 25, with which the receptacle 5 engages for location. The arrangement of the pegs 25 is such that the receptacle 5 can be accommodated in only one position.

Figure 6:
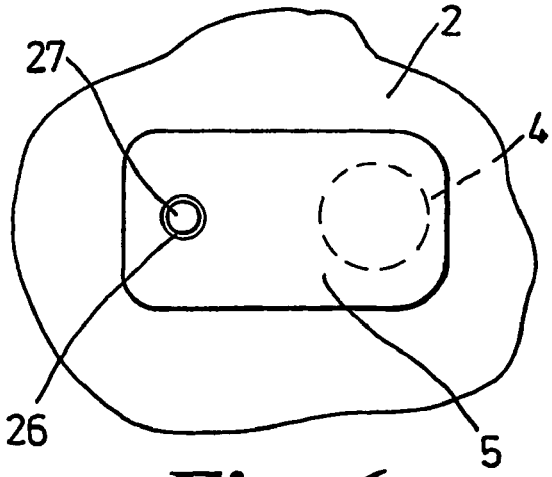
FIG. 6 shows a further modification.

FIG. 6 shows another modification, in which the receptacle 5 is of a different shape, and has an aperture 26 spaced from the boss 20. The outer sole 2 has a corresponding upstanding pillar 27, received in the aperture 26 to locate the receptacle 5 in the outer sole 2. With this arrangement the receptacle 5 need not be of non-rotationally symmetrical outline.

In a further modification (not shown) the receptacle 5 could be of unitary construction rather than formed from two parts. The advantage of the two-part construction is that any standard receptacle can be overmoulded for specific orientation.

The invention claimed is:

1. Means for permitting a specifically-oriented receptacle for a shoe stud to be oriented in only one possible rotational position relative to and in a multi-layer shoe sole including an outer shoe sole and an inner shoe sole, wherein said means comprises co-operating orienting means on said receptacle and said outer shoe sole, said co-operating orienting means being operative to receive and physically retain said receptacle in said only one possible rotational position in said outer shoe sole while preventing rotation relative to said outer shoe sole at least until said inner shoe sole is secured to said outer shoe sole wherein said orienting means comprises an additional part secured to said receptacle, co-operating with a formation on said outer shoe sole;

wherein said additional part comprises a flange projecting from at least part of the periphery of said receptacle; and wherein said flange is of rotationally symmetrical shape, but has an aperture or apertures arranged to provide non-rotational symmetry.

2. Means according to claim 1, wherein said co-operating formation on said outer shoe sole comprises a recess corresponding to said additional part.

3. Means according to claim 2, wherein said recess is defined by a continuous projecting wall.

4. Means according to claim 2, wherein said recess is defined by spaced projections.

5. Means according to claim 1, wherein said outer shoe sole is provided with projections corresponding to and received by said apertures to provide the necessary orientation.

6. Means according to claim 1, wherein said flange is formed integrally with said receptacle.

7. Means according to claim 1, wherein said flange is moulded over said receptacle, in a separate operation.

8. Apparatus for specifically orienting a stud in a receptacle secured in a shoe sole such that the stud has only one permissible rotational orientation relative to the sole, said apparatus comprising:

means securing said receptacle in said sole to rotationally receive and lock a stud in only one permitted rotational position relative to said receptacle;

orienting means for permitting said receptacle to be secured in said shoe sole in only one rotational orientation and thereby determining said only one permissible rotational orientation of the stud relative to the sole, said orienting means comprising:

located in said receptacle:

a boss having an opening at one end, for rotationally receiving a spigot of the stud; and a plate secured to and extending laterally beyond said boss, said plate having a predetermined rotationally asymmetric periphery;

located in said sole:

engagement means for receiving said plate in only one possible rotational orientation to prevent rotational movement of the plate relative to the sole;

wherein said engagement means comprises a recess defined in said sole, said recess having a peripheral boundary corresponding to said predetermined rotationally asymmetric periphery of said plate;

wherein said predetermined rotationally asymmetric periphery includes a plurality of discrete intersecting sides; and wherein said engagement means comprises a plurality of upstanding members secured to said sole and spaced to define an area therebetween for receiving said plate such that the plate can be accommodated in only one position.

* * * * *